US010647926B2

(12) United States Patent
Bourane et al.

(10) Patent No.: US 10,647,926 B2
(45) Date of Patent: May 12, 2020

(54) DESULFURIZATION OF HYDROCARBON FEED USING GASEOUS OXIDANT

(75) Inventors: Abdennour Bourane, Ras Tanura (SA); Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 560 days.

(21) Appl. No.: 13/993,918

(22) PCT Filed: Dec. 14, 2011

(86) PCT No.: PCT/US2011/064825

§ 371 (c)(1),
(2), (4) Date: Aug. 16, 2013

(87) PCT Pub. No.: WO2012/082851

PCT Pub. Date: Jun. 21, 2012

(65) Prior Publication Data

US 2013/0334103 A1 Dec. 19, 2013

Related U.S. Application Data

(60) Provisional application No. 61/423,445, filed on Dec. 15, 2010.

(51) Int. Cl.
*C10G 27/00* (2006.01)
*C10G 27/12* (2006.01)
(Continued)

(52) U.S. Cl.
CPC ..... *C10G 27/12* (2013.01); *C10G 21/00* (2013.01); *C10G 21/28* (2013.01); *C10G 25/00* (2013.01);
(Continued)

(58) Field of Classification Search
CPC ..... C10G 27/00–14
See application file for complete search history.

(56) References Cited

U.S. PATENT DOCUMENTS 1,946,114 A * 2/1934 Leo Schlecht ..... C01B 21/22 423/404
3,668,117 A 6/1972 Patel et al.
(Continued)

FOREIGN PATENT DOCUMENTS

RU 2219160 C1 12/2003
WO 0218518 A1 3/2002
(Continued)

OTHER PUBLICATIONS

Oae, Shigeru, Koich Shinhama, Daikich Fukushima, and Yong Kim. "Oxidation of Organic Sulfur Compounds With Dinitrogen Tetroxide." Phosphorous and Sulfur and the Related Elements 6.1-2 (1979) (Abstract Only).
(Continued)

*Primary Examiner* — Michelle Stein
(74) *Attorney, Agent, or Firm* — Abelman, Frayne & Schwab

(57) ABSTRACT

An apparatus and process for desulfurization of hydrocarbon feeds is disclosed in which pure nitrous oxide, or a mixture of nitrous oxide and oxygen or air, is used as a gaseous oxidant. Organosulfur compounds are converted to their corresponding oxides sulfones and/or sulfoxides in an oxidation reactor, and oxides are subsequently removed from the oxidation reactor effluent to recover a reduced sulfur-content hydrocarbon product.

35 Claims, 2 Drawing Sheets

(51) Int. Cl.

| | |
|---|---|
| ***C10G 53/14*** | (2006.01) |
| ***C10G 53/04*** | (2006.01) |
| ***C10G 27/04*** | (2006.01) |
| ***C10G 21/00*** | (2006.01) |
| ***C10G 25/00*** | (2006.01) |
| ***C10G 53/08*** | (2006.01) |
| ***C10G 21/28*** | (2006.01) |

(52) U.S. Cl.
CPC ..... *C10G 27/04* (2013.01); *C10G 53/04* (2013.01); *C10G 53/08* (2013.01); *C10G 53/14* (2013.01); *C10G 2300/202* (2013.01); *C10G 2300/4037* (2013.01); *C10G 2300/44* (2013.01)

(56) References Cited

U.S. PATENT DOCUMENTS

| | | | | |
|---|---|---|---|---|
| 4,746,420 | A | 5/1988 | Darian et al. | |
| 6,171,478 | B1 | 1/2001 | Cabrera et al. | |
| 6,277,271 | B1 * | 8/2001 | Kocal | C10G 67/12 208/196 |
| 6,312,657 | B1 | 11/2001 | Chang et al. | |
| 7,666,297 | B2 | 2/2010 | Lee et al. | |
| 9,574,144 | B2 * | 2/2017 | Bourane | C10G 21/06 |
| 9,598,647 | B2 * | 3/2017 | Bourane | C10G 21/003 |
| 2004/0089321 | A1 | 5/2004 | Stone | |
| 2005/0040078 | A1 * | 2/2005 | Zinnen | C10G 27/04 208/212 |
| 2007/0051667 | A1 * | 3/2007 | Martinie | C10G 27/00 208/208 R |
| 2008/0110802 | A1 | 5/2008 | Gondal et al. | |
| 2009/0242458 | A1 * | 10/2009 | Soloveichik | C10G 27/00 208/113 |
| 2010/0300938 | A1 | 12/2010 | Martinie et al. | |

FOREIGN PATENT DOCUMENTS

| | | | |
|---|---|---|---|
| WO | 03014266 | A1 | 2/2003 |
| WO | 2006071793 | A1 | 7/2006 |
| WO | 2009120238 | A1 † | 10/2009 |
| WO | WO 2009/120238 | * | 10/2009 |

OTHER PUBLICATIONS

PCT/US2011/064825, International Search Report and Written Opinion dated Apr. 16, 2012, 10 pages.

Janos Madarasz, et al., "Comparative evolved gas analyses of crystalline and amorphous titanium(IV)oxo-hydroxo-acetylacetonates by TG-FTIR and TG/DTA-MS," Thermochimica Acta., 489:37-44 (2009).

* cited by examiner
† cited by third party

DESULFURIZATION OF HYDROCARBON FEED USING GASEOUS OXIDANT

RELATED APPLICATIONS

The present application is a United States national phase application under 35 USC § 371 of PCT/US2011/064825 filed on Dec. 14, 2011, which claims the benefit of U.S. patent application Ser. No. 61/423,445 filed Dec. 15, 2010, the disclosures of which are hereby incorporated by reference in their entireties.

BACKGROUND OF THE INVENTION

1. Field of the Invention

The present invention relates to oxidative desulfurization processes to efficiently reduce the sulfur content of hydrocarbons, and more particularly an oxidative desulfurization process using nitrous oxide as a gaseous oxidant to produce hydrocarbons products including fuels having ultra low sulfur content.

2. Description of Related Art

The discharge into the atmosphere of sulfur compounds during processing and end-use of the petroleum products derived from sulfur-containing sour crude oil pose health and environmental problems. The stringent reduced-sulfur specifications applicable to transportation and other fuel products have impacted the refining industry, and it is necessary for refiners to make capital investments to greatly reduce the sulfur content in gas oils to 10 parts per million by weight (ppmw), or less. In industrialized nations such as the United States, Japan and the countries of the European Union, refineries for transportation fuel have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the direction of the United States and the European Union and are moving forward with regulations that will require refineries to produce transportation fuels with an ultra-low sulfur level.

To keep pace with recent trends toward production of ultra-low sulfur fuels, refiners must choose among the processes or crude oils that provide flexibility to ensure that future specifications are met with minimum additional capital investment, in many instances by utilizing existing equipment. Conventional technologies such as hydrocracking and two-stage hydrotreating offer solutions to refiners for the production of clean transportation fuels. These technologies are available and can be applied as new grassroots production facilities are constructed. However, many existing hydroprocessing facilities, such as those using relatively low pressure hydrotreaters were constructed before these more stringent sulfur reduction requirements were enacted and represent a substantial prior investment. It is very difficult to upgrade existing hydrotreating reactors in these facilities because of the comparatively more severe operational requirements (i.e., higher temperature and pressure conditions) to obtain clean fuel production. Available retrofitting options for refiners include elevation of the hydrogen partial pressure by increasing the recycle gas quality, utilization of more active catalyst compositions, installation of improved reactor components to enhance liquid-solid contact, the increase of reactor volume, and the increase of the feedstock quality.

There are many hydrotreating units installed worldwide producing transportation fuels containing 500-3000 ppmw sulfur. These units were designed for, and are being operated at, relatively mild conditions, i.e., low hydrogen partial pressures of 30 kilograms per square centimeter for straight run gas oils boiling in the range of 180° C.-370° C.

However, with the increasing prevalence of more stringent environmental sulfur specifications in transportation fuels mentioned above, the maximum allowable sulfur levels are being reduced to no greater than 15 ppmw, and in some cases no greater than 10 ppmw. This ultra-low level of sulfur in the end product typically requires either construction of new high pressure hydrotreating units, or a substantial retrofitting of existing facilities, e.g., by integrating new reactors, incorporating gas purification systems, reengineering the internal configuration and components of reactors, and/or deployment of more active catalyst compositions. Each of these options represents a substantial capital investment.

Sulfur-containing compounds that are typically present in hydrocarbon fuels include aliphatic molecules such as sulfides, disulfides and mercaptans, as well as aromatic molecules such as thiophene, benzothiophene and its alkylated derivatives, and dibenzothiophene (DBT) and its alkyl derivatives such as 4,6-dimethyl-dibenzothiophene (DMDBT).

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

Relative hydrodesulfurization reactivities and activation of sulfur compounds are shown in the below table:

TABLE 1

| Name | DBT | 4-methy-DBT | 4,6-DMDBT |
|---|---|---|---|
| Structure | 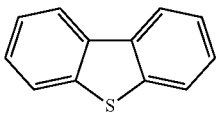 | 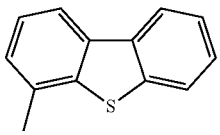 | 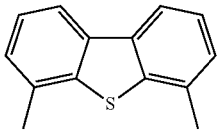 |

TABLE 1-continued

| Name | DBT | 4-methy-DBT | 4,6-DMDBT |
|---|---|---|---|
| Reactivity $k_{@250}$, $s^{-1}$ | 57.7 | 10.4 | 1.0 |
| Reactivity $k_{@300}$, $s^{-1}$ | 7.3 | 2.5 | 1.0 |
| Activation Energy $E_a$, Kcal/mol | 28.7 | 36.1 | 53.0 |

Relative reactivities of sulfur compounds based on their first order reaction rates at 250° C. and 300° C., and 40.7 $Kg/cm^2$ hydrogen partial pressure over Ni—Mo/Alumina catalyst are given (Steiner, P. et al., "Catalytic hydrodesulfurization of a light gas oil over a NiMo catalyst: kinetics of selected sulfur components," *Fuel Processing Technology*, Vol. 79, Issue 1, Aug. 20, 2002, pages 1-12) in Table 1. DBT is 57 times more reactive than the refractory 4,6-DMDBT at 250° C. The relative reactivity decreases with increasing operating severity. With a 50° C. temperature increase, the relative reactivity of di-benzothiophene compared to 4,6-DMDBT decreases to 7.3 from 57.7.

The development of non-catalytic processes for desulfurization of petroleum distillate feedstocks has been widely studied, and certain conventional approaches are based on oxidation of sulfur-containing compounds described, e.g., in U.S. Pat. Nos. 5,910,440, 5,824,207, 5,753,102, 3,341,448 and 2,749,284.

Oxidative desulfurization is attractive for several reasons. First, conventional liquid phase oxidative desulfurization can occur at temperatures ranging from room temperature up to 200° C. and pressures ranging from 1 up to 15 atmospheres, thereby resulting a priori in reasonable investment and operational costs, especially compared to hydrogen consumption in hydroprocessing techniques which is usually expensive. Another attractive aspect of the oxidative process is related to the reactivity of aromatic sulfur-containing species. This is evident since the high electron density at the sulfur atom caused by the attached electron-rich aromatic rings, which is further increased with the presence of additional alkyl groups on the aromatic rings, will favor its electrophilic attack as shown in Table 2 (Otsuki, S. et al., "Oxidative desulfurization of light gas oil and vacuum gas oil by oxidation and solvent extraction," *Energy Fuels* 14:1232-1239 (2000)). However, the intrinsic reactivity of molecules such as 4,6-DMDBT is substantially higher than that of DBT, which is much easier to desulfurize by hydrodesulfurization.

TABLE 2

Electron Density of selected sulfur species

| Sulfur compound | Formulas | Electron Density | K (L/(mol·min)) |
|---|---|---|---|
| Thiophenol | 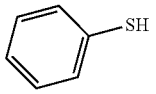 | 5.902 | 0.270 |
| Methyl Phenyl Sulfide | 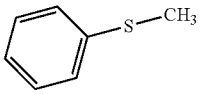 | 5.915 | 0.295 |
| Diphenyl Sulfide | 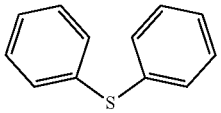 | 5.860 | 0.156 |
| 4,6-DMDBT | 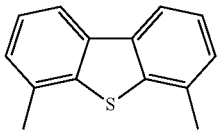 | 5.760 | 0.0767 |
| 4-MDBT | 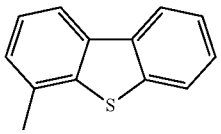 | 5.759 | 0.0627 |
| DBT | 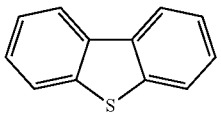 | 5.758 | 0.0460 |

TABLE 2-continued

| Electron Density of selected sulfur species | | | |
|---|---|---|---|
| Sulfur compound | Formulas | Electron Density | K (L/(mol·min)) |
| Benzothiophene | 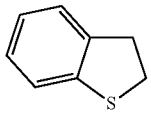 | 5.739 | 0.00574 |
| 2,5-Dimethylthiophene | 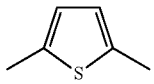 | 5.716 | — |
| 2-methylthiophene | 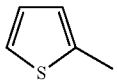 | 5.706 | — |
| Thiophene | 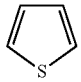 | 5.696 | — |

Gondal et al. US 2008/0110802 discloses the removal of DMDBT by photoexciting atomic or molecular oxygen to a singlet or triplet energy state, mixing the photoexcited oxygen with the hydrocarbon fuel, and irradiating the hydrocarbon fuel with UV radiation from a tunable laser source at a wavelength corresponding to an absorption band of DMDBT. $N_2O$ is listed as one of the possible sources of oxygen. Laser-induced photolyzation of $N_2O$ is required in order to produce sufficient quantities of reactive oxygen species to promote oxidative desulfurization, which can be more costly and less efficient than other existing oxidative desulfurization processes. In addition, use of chemical catalysts are not disclosed by Gondal et al.

Darian et al. U.S. Pat. No. 4,746,420 discloses a process for decreasing the sulfur content and increasing the cetane number of a diesel oil. This process includes a first step in which diesel oil is contacted with nitrogenous agents followed with a liquid extraction aiming at removing sulfur containing impurities, instability causing compounds, Ramsbottom carbon, cetane depressing compounds and aromatic compounds. Although nitrogenous compounds are cited as reacting agents (including nitrous oxide) in the first step of process described in the Darian et al. reference, the goal of using such compounds is the promotion of nitration and esterification reactions of diesel oil, rather than oxidation of sulfur compounds. Moreover, the Darian et al. reference clearly teaches away from the use of oxidation catalysts.

Kocal U.S. Pat. No. 6,277,271 relates to a process for the desulfurization of oil comprising a first step of hydrodesulfurization followed by an oxidation step and finally an extraction step. While the Kocal reference lists nitrogen oxide broadly as potential oxidant in the oxidation step, the working examples only show use of peroxides in conjunction with an oxidant gas and with acetic acid. In addition, the Kocal reference does not disclose the use of inorganic catalysts.

None of the above-mentioned references describe an efficient and efficacious process for catalytic oxidative desulfurization using a gaseous oxidant.

Accordingly, it is an object of the present invention to desulfurize a hydrocarbon feedstock utilizing efficient gas phase oxidation thereby minimizing aqueous handling and removal requirements.

SUMMARY OF THE INVENTION

The above object and further advantages are provided by the apparatus and process for desulfurization of hydrocarbon feeds in which pure nitrous oxide, or a mixture of nitrous oxide and oxygen or air, is used as a gaseous oxidant.

Oxidation processes by gaseous air or oxygen, or by organic peroxides, peroxyacids, or peacetic acids, are known in the art. In contrast to the conventional approaches, the present invention discloses an oxidation route that uses pure nitrous oxide, or a mixture of nitrous oxide and air or oxygen.

The apparatus and process for desulfurization of hydrocarbon feeds containing organosulfur compounds impurities to produce a refinery transportation fuel or blending components for refinery transportation fuel, or other refined hydrocarbon fraction, includes a. contacting the feedstock with a nitrous oxide ($N_2O$) containing gas in an oxidation reactor at oxidation conditions in the presence of a heterogeneous or homogeneous oxidation catalyst, whereby organosulfur compounds are converted to their corresponding oxides sulfones and/or sulfoxides, and b. removing oxides from the oxidation reactor effluent to recover a hydrocarbon product having reduced content of organosulfur compounds.

BRIEF DESCRIPTION OF THE DRAWINGS

The foregoing summary, as well as the following detailed description of preferred embodiments of the invention will be best understood when read in conjunction with the attached drawings. For the purpose of illustrating the invention, there are shown in the drawings embodiments which are presently preferred. It should be understood, however, that the invention is not limited to the precise arrangements and apparatus shown. In the drawings the same numerals are used to refer to the same or similar elements, in which.

DETAILED DESCRIPTION OF THE INVENTION

The present invention comprehends an oxidative desulfurization process to produce hydrocarbon fuels with a reduced content of organosulfur compounds. The process includes the following steps:

a. contacting a hydrocarbon feedstock containing organosulfur compounds with a gaseous oxidizing agent consisting essentially of pure nitrous oxide ($N_2O$) or $N_2O$ in combination with oxygen, and a heterogeneous or homogeneous oxidation catalyst, in an oxidation reaction zone to convert the organosulfur compounds into oxidized sulfur-containing compounds; and b. removing oxidized sulfur-containing compounds in a separation zone by oxidation product removal processes and apparatus that include extraction, distillation, adsorption, or combined processes comprising one or more of extraction, distillation and adsorption.

The hydrocarbon feedstock to be desulfurized according to the present invention can be one or a combination of a variety of feedstocks, including but not limited to whole crude oil; fractional distillates boiling in the range of about 36° C. to about 370° C.; residues boiling above 370° C.; hydrocarbons from intermediate refinery processing units such as coking gas oils, FCC cycle oils, or deasphalted oils; bitumens from tar sands and/or its cracked products; or coal liquids. In certain embodiments, diesel feedstocks are used, as they are relatively easy to handle at mild conditions, and the targeted sulfur molecules such as di-methyl-dibenzothiophene and its derivatives are reactive at oxidation conditions. Their electron structures enable them to react at these mild conditions.

Figure 1:
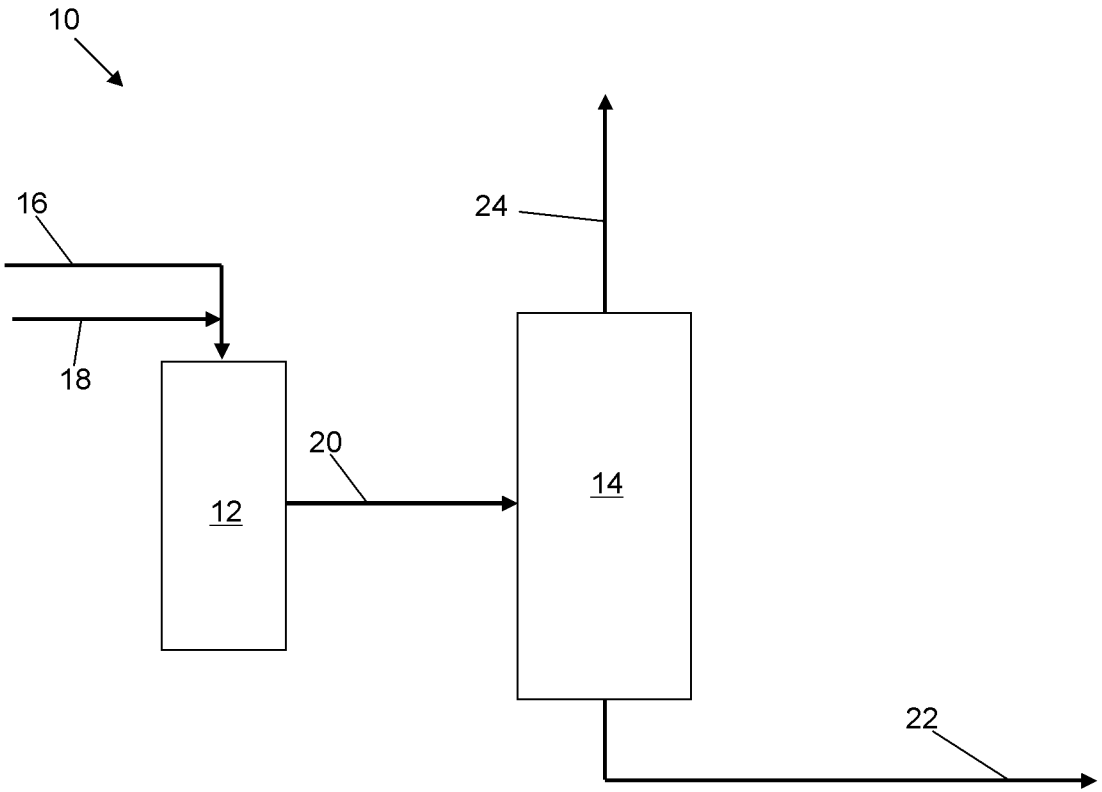
FIG. 1 is a schematic diagram of a desulfurization system and process of the present invention that includes gas-phase oxidative desulfurization.

Referring now to FIG. 1, an oxidative desulfurization apparatus 10 according to the present invention is schematically illustrated. Apparatus 10 includes an oxidative desulfurization reaction zone 12 and a separation zone 14. A hydrocarbon stream 16 and a gaseous oxidant stream 18 are introduced to the oxidative desulfurization reaction zone 12 operating at mild operating conditions. As used herein, "mild operating conditions" include: operating pressures of from about 1 bar to about 90 bars, in certain embodiments about 10 bars to about 50 bars, and in further embodiments about 10 bars to about 30 bars; and temperatures of from about 100° C. to about 400° C., in certain embodiments about 100° C. to about 350° C., and in further embodiments about 150° C. to about 300° C.

In certain embodiments the gaseous oxidizing agent is supplied in gaseous form, and can be:

a. essentially pure nitrous oxide; or b. a mixture consisting essentially of nitrous oxide and a source of gaseous oxygen, having a nitrous oxide molar concentration ranging from about 1% to about 99%, in certain embodiments about 10% to about 50% and in further embodiments about 20% to about 30%.

In additional embodiments, the gaseous oxidant can be formed in a separate vessel (not shown) upstream of the oxidative desulfurization reaction zone 12, or in situ in the oxidative desulfurization reaction zone 12, e.g. by reaction of ammonia and oxygen.

The oxidation catalyst can be selected from one or more heterogeneous or homogeneous catalysts having metals from Group IVB to Group VIIIB of the Periodic Table, including those selected from of Ti, V, Mn, Co, Fe, Cr and Mo. In certain embodiments, suitable homogeneous catalysts include molybdenum naphthanate, sodium tungstate, molybdenum hexacarbonyl, tungsten hexacarbonyl, and vanadium pentaoxide. In certain embodiments, suitable heterogeneous catalysts include Ti, V, Mn, Co, Fe, Cr and Mo or combination thereof deposited on a support such alumina, silica-alumina, silica, natural zeolites, synthetic zeolites, or combinations comprising one or more of the above supports.

The feedstock, the gaseous oxidizing agent and the oxidation catalyst are maintained in contact for a period of time that is sufficient to complete the oxidation reactions, generally about 1 to about 120 minutes, in certain embodiments about 15 to about 60 minutes and in further embodiments about 30 minutes to about 60 minutes. The reaction conditions of the oxidative desulfurization zone 12 include: an operating pressure of about 1 bar to about 90 bars, in certain embodiments about 10 bars to about 50 bars and in further embodiments at about 10 bars to about 30 bars; and an operating temperature of about 100° C. to about 400° C., in certain embodiments about 150° C. to about 350° C. and in further embodiments about 150° C. to about 300° C.

The catalyst-to-feedstock ratio for homogeneous catalyst systems is generally about 0.01 W % to about 10 W %, in certain embodiments about 0.01 W % to about 5 W %, and in further embodiments about 0.01 W % to about 1 W %. For heterogeneous catalyst systems, the liquid hourly space velocity over the catalyst volume is about 0.1 h-1 to about 8.0 h-1, in certain embodiments about 0.5 h-1 to about 4.0 h-1, and in further embodiments about 1 h-1 to about 2.0 h-1.

The molar feed ratio of gaseous oxidizing agent to sulfur is generally about 10 to about 1, in certain embodiments about 5 to about 1, and in further embodiments about 2 to about 1.

In the oxidative desulfurization zone 12, at least a substantial portion of the sulfur-containing compounds are converted to oxidized sulfur-containing compounds, i.e. sulfones and sulfoxides, and discharged as an oxidized hydrocarbon stream 20.

Stream 20 from the oxidative desulfurization zone 12 is passed to the separation zone 14 to remove the oxidized sulfur-containing compounds as discharge stream 22. In certain preferred embodiments, a hydrocarbon stream 24 is obtained that contains an ultra-low level of sulfur, i.e., less than 15 ppmw. For instance, the oxide content, e.g., sulfones and/or sulfoxides, can be reduced by solvent extraction using polar solvents and adsorption using solid adsorbents.

Stream 22 from the separation zone 14 is passed to sulfones and sulfoxides handling unit (not shown) to recover hydrocarbons free of sulfur, for example, by cracking reactions, thereby increasing the total hydrocarbon product yield. Alternatively, stream 22 can be passed to other refining processes such as coking or solvent deasphalting.

Figure 2:
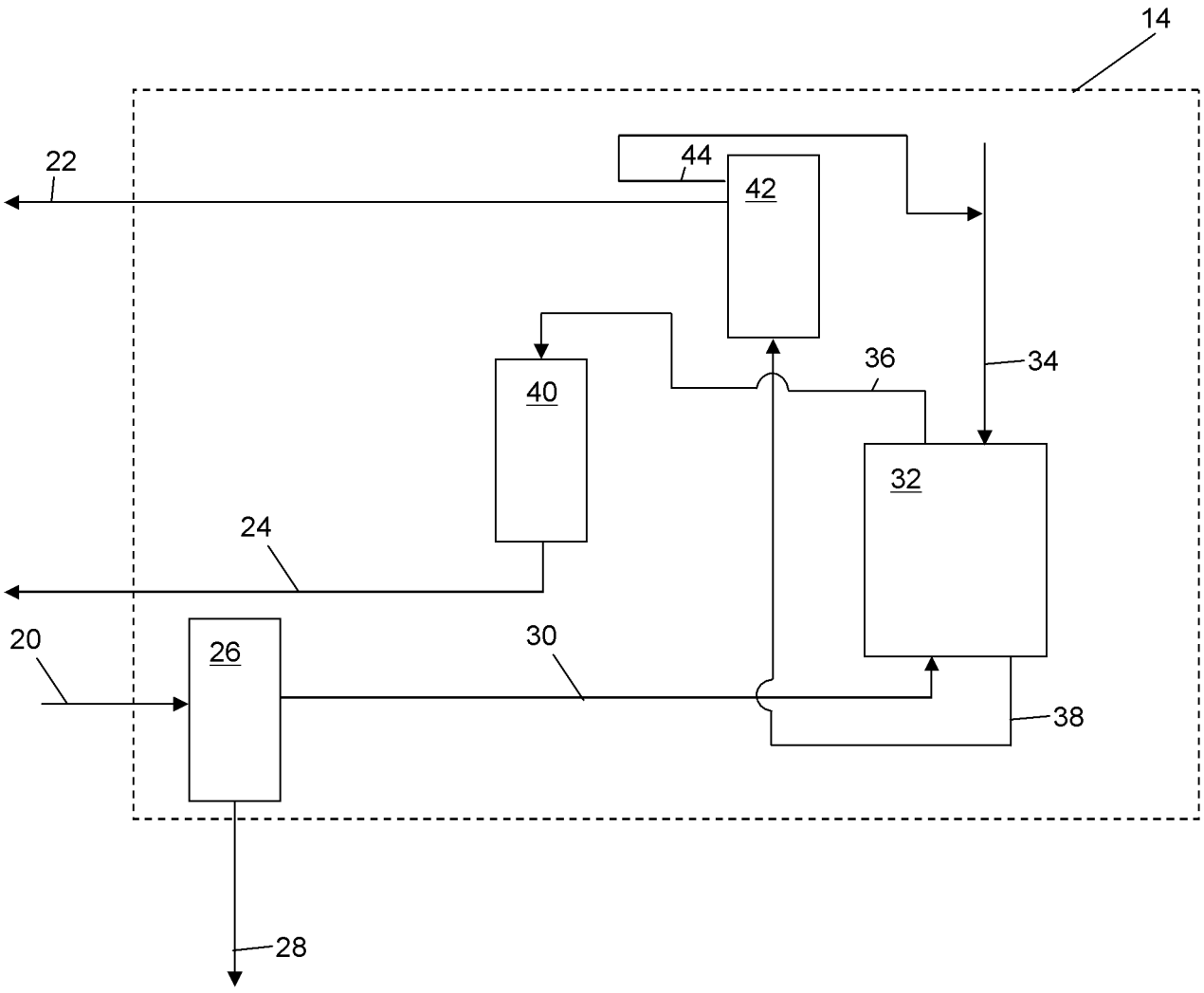
FIG. 2 is a schematic diagram of a separation apparatus for removing oxidized organosulfur compounds from an oxidized feedstock.

Referring to FIG. 2, the oxidized hydrocarbon stream 20 is introduced generally to the separation zone 14. In particular hydrocarbon stream 20 is passed to a vessel 26 to remove catalyst (if a homogeneous catalyst system is used) and/or water as discharge stream 28 and separate a hydrocarbon mixture stream 30. The hydrocarbon stream 30 is introduced into one end of a counter-current extractor 32, and a solvent stream 34 is introduced into the opposite end. Oxidized sulfur-containing compounds are extracted from the hydrocarbon stream with the solvent as solvent-rich extract stream 38. The solvent stream 34 can include a selective solvent such as methanol, acetonitrile, any polar solvent having a Hildebrandt value of at least 19, and combinations comprising at least one of the foregoing solvents. Acetonitrile and methanol are preferred solvents for the extraction due to their polarity, volatility, and low cost. The efficiency of the separation between the sulfones and/or sulfoxides can be optimized by selecting solvents having desirable properties including, but not limited to boiling point, freezing point, viscosity, and surface tension. The raffinate 36 is introduced into an adsorption column 40 where it is contacted with an adsorbent material such as an alumina adsorbent to produce the finished hydrocarbon product stream 24 that has an ultra-low level of sulfur, which is recovered. The solvent-rich extract 38 from the extractor 32 is introduced into the distillation column 42 for solvent recovery via the overhead recycle stream 44. Stream 22 includes oxidized sulfur-containing compounds, i.e., sulfones and/or sulfoxides.

The present invention offers distinct advantages when compared to conventional processes for desulfurization of hydrocarbon fuel. For example, in certain conventional approaches to oxidative desulfurization, aqueous solutions of oxidant are used to convert organosulfur compounds to their corresponding sulfoxides and/or sulfones, requiring subsequent steps to remove excess oxidant and water from oil. This can be increasingly difficult if the mixture contains water-oil emulsions. However, in the present invention, by using gaseous oxidant, the aqueous content from aqueous oxidants is avoided, thereby minimizing these handling problems.

The method and system of the present invention have been described above and in the attached drawings; however, modifications will be apparent to those of ordinary skill in the art and the scope of protection for the invention is to be defined by the claims that follow.

The invention claimed is:

1. A process for reducing the content of organosulfur compounds in a liquid hydrocarbon feedstream comprising:

contacting the feedstream with an oxidation catalyst and an oxidant consisting essentially of nitrous oxide at a temperature of at least 150° C. and in an oxidant-to-feedstream molar ratio of 10:1 to 1:1 to produce oxidized organosulfur compounds; and removing at least a majority of the oxidized organosulfur compounds from the treated feedstream.

2. A process for reducing the content of organosulfur compounds in a liquid hydrocarbon feedstream comprising:

contacting the feedstream with an oxidation catalyst and an oxidant consisting essentially of nitrous oxide and a source of gaseous oxygen at a temperature of at least 150° C. and in an oxidant-to-feedstream volumetric ratio of 10:1 to 1:1 to produce oxidized organosulfur compounds; and removing at least a majority of the oxidized organosulfur compounds from the treated feedstream.

3. A process for reducing the content of organosulfur compounds in a liquid hydrocarbon feedstream comprising:

forming a nitrous oxide oxidant by reaction of ammonia and oxygen;

contacting the feedstream with an oxidation catalyst and an oxidant consisting essentially of the formed nitrous oxide oxidant, or consisting essentially of nitrous oxide and a source of gaseous oxygen, at a temperature of at least 150° C. and in an oxidant-to-feedstream volumetric ratio of 10:1 to 1:1 to produce oxidized organosulfur compounds; and removing at least a majority of the oxidized organosulfur compounds from the treated feedstream.

4. The process of claim 3, wherein forming the nitrous oxide oxidant occurs in situ within a vessel in which oxidation reaction with the feedstream occurs.

5. The process of claim 3, wherein forming the nitrous oxide oxidant occurs upstream of a vessel in which oxidation reaction with the feedstream occurs.

6. The process as in claim 1, wherein removing at least a majority of the oxidized organosulfur compounds comprises extracting oxidized sulfur compounds with a polar solvent to produce a solvent-rich extract containing organosulfur sulfur compounds and a solvent-lean raffinate containing hydrocarbons having a reduced content of organosulfur compounds.

7. The process as in claim 6, further comprising flashing the solvent-rich extract to recover the polar solvent and discharge the oxidized organosulfur compounds.

8. The process as in claim 6, further comprising stripping solvent from the solvent-lean raffinate and recovering hydrocarbons having a reduced organosulfur content.

9. The process as in claim 8, further comprising contacting the recovered hydrocarbons with adsorbent material.

10. The process as in claim 2, wherein removing at least a majority of the oxidized organosulfur compounds comprises extracting oxidized sulfur compounds with a polar solvent to produce a solvent-rich extract containing organosulfur sulfur compounds and a solvent-lean raffinate containing hydrocarbons having a reduced content of organosulfur compounds.

11. The process as in claim 10, further comprising flashing the solvent-rich extract to recover the polar solvent and discharge the oxidized organosulfur compounds.

12. The process as in claim 10, further comprising stripping solvent from the solvent-lean raffinate and recovering hydrocarbons having a reduced organosulfur content.

13. The process as in claim 12, further comprising contacting the recovered hydrocarbons with adsorbent material.

14. The process as in claim 3, wherein removing at least a majority of the oxidized organosulfur compounds comprises extracting oxidized sulfur compounds with a polar solvent to produce a solvent-rich extract containing organosulfur sulfur compounds and a solvent-lean raffinate containing hydrocarbons having a reduced content of organosulfur compounds.

15. The process as in claim 14, further comprising flashing the solvent-rich extract to recover the polar solvent and discharge the oxidized organosulfur compounds.

16. The process as in claim 14, further comprising stripping solvent from the solvent-lean raffinate and recovering hydrocarbons having a reduced organosulfur content.

17. The process as in claim 16, further comprising contacting the recovered hydrocarbons with adsorbent material.

18. The process of claim 1, wherein the oxidation catalyst is a heterogeneous catalyst.

19. The process of claim 18, wherein the heterogeneous catalyst includes a metal from Group IVB to Group VIIIB of the Periodic Table.

20. The process of claim 18, wherein the heterogeneous oxidation catalyst includes a metal selected from the group consisting of Ti, V, Mn, Co, Fe, Cr and Mo.

21. The process of claim 20, wherein the heterogeneous oxidation catalyst includes a support material selected from the group consisting of alumina, silica-alumina, silica, titania, natural zeolites, synthetic zeolites, and combinations comprising one or more of alumina, silica-alumina, silica, titania, natural zeolites, synthetic zeolites.

22. The process of claim 1, wherein the contacting step occurs at reaction conditions including an operating pressure of about 1 bar to about 90 bars.

23. The process of claim 1, wherein the contacting step occurs at reaction conditions including an operating pressure of about 10 bars to about 50 bars.

24. The process of claim 2, wherein the oxidation catalyst is a heterogeneous catalyst.

25. The process of claim 24, wherein the heterogeneous catalyst includes a metal from Group IVB to Group VIIIB of the Periodic Table.

26. The process of claim 24, wherein the heterogeneous oxidation catalyst includes a metal selected from the group consisting of Ti, V, Mn, Co, Fe, Cr and Mo.

27. The process of claim 26, wherein the heterogeneous oxidation catalyst includes a support material selected from the group consisting of alumina, silica-alumina, silica, titania, natural zeolites, synthetic zeolites, and combinations comprising one or more of alumina, silica-alumina, silica, titania, natural zeolites, synthetic zeolites.

28. The process of claim 2, wherein the contacting step occurs at reaction conditions including an operating pressure of about 1 bar to about 90 bars.

29. The process of claim 2, wherein the contacting step occurs at reaction conditions including an operating pressure of about 10 bars to about 50 bars.

30. The process of claim 3, wherein the oxidation catalyst is a heterogeneous catalyst.

31. The process of claim 30, wherein the heterogeneous oxidation catalyst includes a metal from Group IVB to Group VIIIB of the Periodic Table.

32. The process of claim 30, wherein the heterogeneous oxidation catalyst includes a metal selected from the group consisting of Ti, V, Mn, Co, Fe, Cr and Mo.

33. The process of claim 32, wherein the heterogeneous oxidation catalyst includes a support material selected from the group consisting of alumina, silica-alumina, silica, titania, natural zeolites, synthetic zeolites, and combinations comprising one or more of alumina, silica-alumina, silica, titania, natural zeolites, synthetic zeolites.

34. The process of claim 3, wherein the contacting step occurs at reaction conditions including an operating pressure of about 1 bar to about 90 bars.

35. The process of claim 3, wherein the contacting step occurs at reaction conditions including an operating pressure of about 10 bars to about 50 bars.

* * * * *